US006789375B2

(12) United States Patent
Honegger

(10) Patent No.: US 6,789,375 B2
(45) Date of Patent: Sep. 14, 2004

(54) METHOD AND APPARATUS FOR COVERING PRINTED PRODUCTS WITH A PACKAGING MATERIAL

(75) Inventor: Werner Honegger, Bach (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/951,150

(22) Filed: Sep. 12, 2001

(65) Prior Publication Data

US 2002/0095913 A1 Jul. 25, 2002

(30) Foreign Application Priority Data

Sep. 18, 2000 (CH) ..... 2000 1816/00

(51) Int. Cl.[7] ..... B65B 9/06
(52) U.S. Cl. ..... 53/450; 543/202
(58) Field of Search ..... 53/450, 550, 202

(56) References Cited

U.S. PATENT DOCUMENTS 2,565,444 A * 8/1951 Waters ..... 53/550
2,673,430 A * 3/1954 Fleischer ..... 53/202
2,691,257 A * 10/1954 Vogt ..... 53/202
2,805,814 A * 9/1957 Calasibetta ..... 383/38
3,377,773 A * 4/1968 Clark ..... 53/548
3,581,457 A * 6/1971 Gerlach et al. ..... 53/450
3,760,559 A * 9/1973 Heinzer ..... 53/202
4,035,984 A * 7/1977 Gerlach et al. ..... 53/450
4,085,560 A 4/1978 McClosky
4,589,145 A * 5/1986 Van Erden et al. ..... 383/204
5,155,979 A * 10/1992 McDonald ..... 53/550

FOREIGN PATENT DOCUMENTS

EP 0 712 782 A1 5/1996
GB 2 088 811 A 6/1982
WO WO 94/10039 5/1994

* cited by examiner

*Primary Examiner*—John Sipos
(74) *Attorney, Agent, or Firm*—Brinks Hofer Gilson & Lione

(57) ABSTRACT

The invention relates to a method and an apparatus for covering printed products with a packaging material in the form of a continuous packaging material web, especially a plastic film. In each case, at least two printed products are deposited beside each other on the packaging material web by means of a feed device. In each case, at least two printed products lying beside each other are covered simultaneously with the packaging material and subsequently divided from each other. The invention permits the packaging rate to be doubled in a simple way, without having to carry out complicated modifications to the packaging apparatus.

8 Claims, 3 Drawing Sheets

METHOD AND APPARATUS FOR COVERING PRINTED PRODUCTS WITH A PACKAGING MATERIAL

FIELD OF THE INVENTION

The invention relates to a method and an apparatus for covering printed products with a packaging material.

BACKGROUND OF THE INVENTION

Individual printed products or a group of a number of printed products are packed for dispatch by being covered on all sides with a wrapper, paper or a film or inserted into envelopes. One method of packing printed products, in which the latter are inserted into packaging elements which are located in insertion compartments in a packing drum, is disclosed by U.S. Pat. No. 5,615,537. With this method, a high throughput of products to be packed is possible, and it necessitates prefabricated packing elements and is therefore correspondingly expensive.

German Patent No. DE-A 31 02 872 discloses a method of covering chocolate bars and the like, in which a continuous packaging material, a metal foil, is folded over to form a tube which is open on one side and has a U-shaped cross section. Bars lying one behind the other in a row are placed into said tube, the open side of the tube then being closed and individual pack units being divided off.

SUMMARY OF THE INVENTION

The invention is based on the object of specifying a method and an apparatus for packing printed products with which a high throughput can be achieved with the lowest possible material and processing costs per pack unit.

According to the invention, at least two printed products are packed in parallel with a common packaging material web. As a result, the tools which are present to feed products, to unwind and fold over the packaging material, especially a plastic film, and to close and, if necessary, divide off the pack units can advantageously be used twice over. The packing rate can be doubled at constant processing speed. According to the invention, the packaging material web is itself used as a transport medium after the printed products have been deposited on it. The material web preferably runs over a support which accommodates the weight of the printed products. It is particularly advantageous if the cross section of the support is bent over upward or downward at right angles to the conveying direction, and has contact elements for printed products, so that the latter assume a defined position with respect to the cutting and closing tools. The continuous packaging material used is preferably a plastic film, but a paper web can also be employed. A plastic film is preferably welded in order to produce the pack, while a paper web is adhesively bonded.

BRIEF DESCRIPTION OF THE DRAWINGS

Exemplary embodiments of the invention are illustrated in the drawing and described below. In the drawing, in purely schematic form.

DESCRIPTION OF THE PREFERRED EMBODIMENTS

Figure 1:
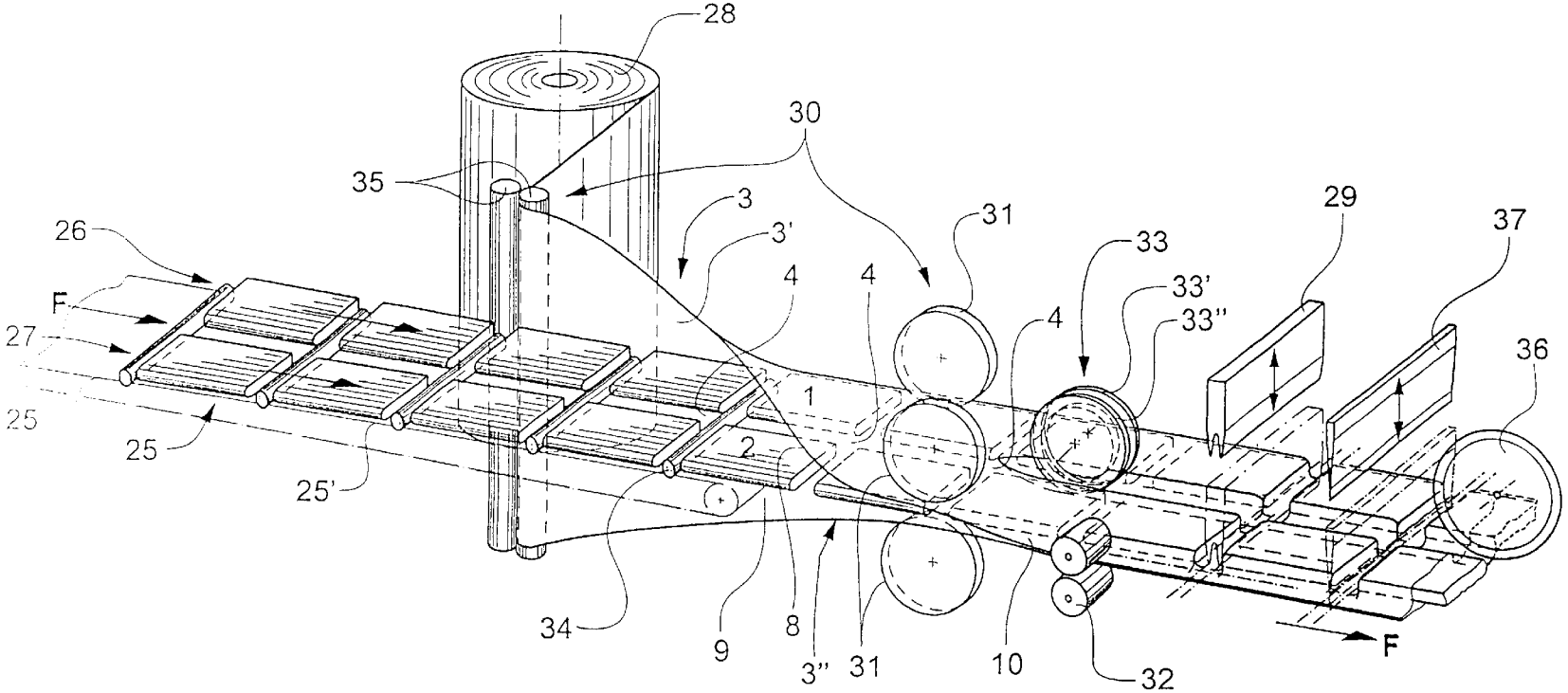
FIG. 1 shows an apparatus for implementing the method.

FIG. 1 shows, schematically, an apparatus for implementing the method according to the invention. A similar apparatus for packing one product in each case is described in DE-A 31 02 872. In relation to the construction and functioning of the apparatus according to the invention, reference is also made to this disclosure.

Printed products 1, 2 are fed to the apparatus in the conveying direction F in two parallel rows 26, 27 by a feed device 25. The feed device 25 has, for example, a conveyor belt 25' with driving elements 34, for example rollers, which are arranged at right angles to the conveying direction F and between which printed products lie. Instead of a belt conveyor, cam conveyors, gripper conveyors and clamp transporters and the like can also be used as the feed device. The printed products do not necessarily have to arrive in rows, but, for example, can also arrive in an overlapping formation or can be drawn off from a stationary stack. In this case, it is merely necessary for two printed products in each case to be deposited beside each other on the packaging material, that is to say the packaging material web 3'.

A packaging material web 3', a plastic film here, is unwound over guide rollers 35 from a feed roll 28 oriented at right angles to the feed device 25 and to the conveying direction F. The packaging material web 3' can also be supplied in any other way and laid around the products. The guide rollers 35 are arranged parallel to the feed roll 28, approximately symmetrically with respect to the plane of the feed device 25.

By means of a turner device 30, which is formed here by pairs of rollers 31, running at the side of the feed device 25, and the guide rollers 35, the initially flat packaging material web 3' is used to form a material tube 3' which has a U-shaped cross section, is open at the sides and has an upper and a lower material layer 8 and 9, respectively. Said hose is laid around the printed products 1, 2 supplied, the latter being deposited on the lower material layer 9 by the feed device 25. The packaging material web 3' itself is used as a transport medium for the printed products 1, 2 after they have been deposited. It is moved in the conveying direction F by the pairs of rollers 31.

Above the central area 4 between the printed product rows 26, 27 and between the printed products 1, 2 there is a first closing device 33 for joining the upper and lower material layers 8, 9. In the present case, the first closing device 33 comprises 2 wheels 33', 33" which can be rotated about a common axis and with which the layers 8, 9 are joined to each other continuously, being welded here, so that two welds running in parallel in the conveying direction F are produced. In order then to divide the pack units of one row 26 from those of the other row 27, a blade 36 oriented in the conveying direction F is arranged as a dividing device downstream of the first closing device 33. Alternatively, a dividing device can also be integrated into the closing device 33, for example a blade can be arranged between the wheels 33', 33" between the welds. In the area of the edge 10, there is arranged a continuously operating second closing device 32, which likewise welds the upper and lower material layers 8, 9 in the edge area in the conveying direction F. Arranged downstream of the first closing device 33, in the conveying direction F, is a third closing device 29 which, transversely with respect to the conveying direction F, joins the packaging material webs (welds them here) in the region between two successive printed products at regular time intervals matched to the conveying speed and the product spacing. Using a second dividing device with a blade 37 oriented transversely with respect to the conveying direction, a finished pack unit is then divided off. It is possible for the second dividing device to be dispensed with for those applications in which the printed products are to be stored temporarily individually packed in a continuous material web tube.

Figure 2:
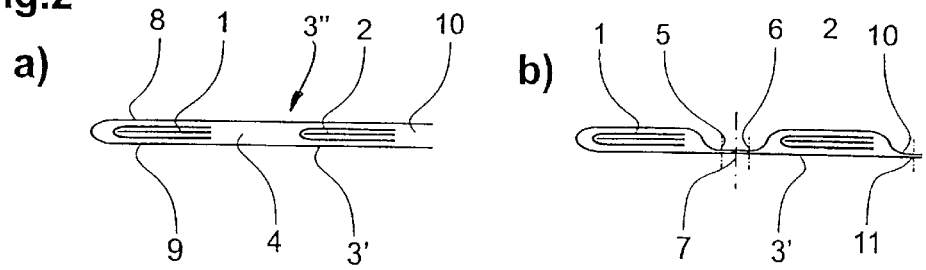
FIGS. 2*a, b* show an example of a method according to the invention, forming a U-shaped, laterally open material tube.

FIGS. 2*a*) and *b*) show two steps in a variant of the method according to the invention, in schematic form. The method can be implemented with the apparatus shown in FIG. 1. A packaging material web 3' in the form of a plastic film is used to form a material tube 3" which has a U-shaped cross section, is open at the side and has an upper and a lower material layer 8 and 9, respectively. Two printed products 1, 2, which arrive in parallel printed product rows, as shown in FIG. 1, are placed beside each other on the lower material layer 9. In the central area 4 between the two printed products 1, 2, the lower and the upper material layers 8 and 9 are welded to each other, forming welds 5, 6 running in the conveying direction F, the packaging material web 3' being divided between them along a cutting line 7 likewise running in the conveying direction F. Alternatively, a wide weld can be formed, which is divided at its center, so that the upper and lower material layers in each case remain joined. To the side of one of the printed products 2, an edge 10 comprising upper and lower material layers 8, 9 projects, and is closed by a further weld 11 running in the conveying direction. In the area between printing products lying one behind the other, the packaging material web 3' is finally welded and cut transversely with respect to the conveying direction F, in order to complete the packaging and to separate printed products which arrive one after the other from one another.

Figure 3:
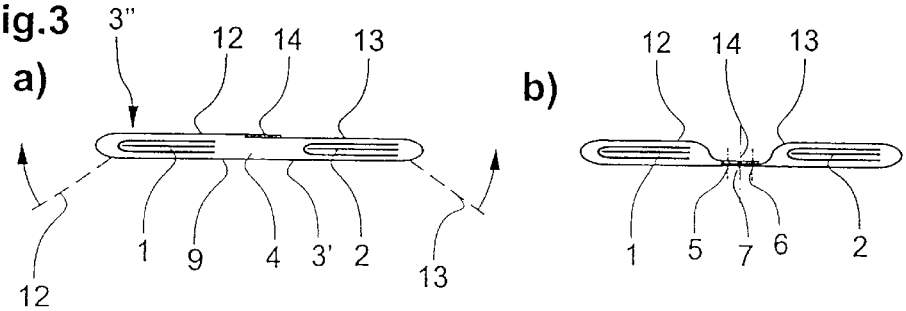
FIGS. 3*a, b* show an example of a method according to the invention, forming a material tube closed at the top.

FIGS. 3*a*), *b*) show two steps in a further variant of the method according to the invention, in schematic form. The printed products 1, 2 are deposited beside each other on the packaging material web 3', to be specific approximately at the center. In this case, first and second outer material areas 12, 13 in each case project laterally outward, which is illustrated by dashed lines. The projecting first and second outer material areas 12, 13 are then folded over toward the central area 4 to form a tube 3" of packaging material. The folded-over first and second outer material areas 12, 13 are sufficiently long that they overlap each other in an overlap area 14. In this overlap area 14 between the printed products 1, 2 arranged beside each other, they are welded to each other and to the material layer lying underneath in one operation. As in the method of FIG. 2, two parallel welds 5, 6 can be applied, a cut being made between them, cutting line 7. This variant has the advantage over the variant of FIG. 2 that, in addition to the necessary welding and dividing transversely with respect to the conveying direction, only one closing device operating in the conveying direction or only one operation is needed in order to form two packs.

Figure 4:
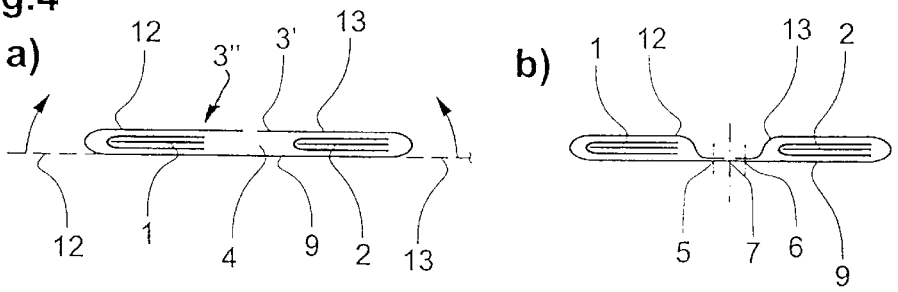
FIGS. 4*a, b* show an example of a method according to the invention, forming a material tube open at the top.

FIGS. 4*a*), *b*) show two steps in a further variant of the method according to the invention, in schematic form, similar to the method from FIGS. 3*a*), *b*). The laterally projecting first and second outer material areas 12, 13 are shown shorter here than in FIGS. 3*a*), *b*), so that they do not overlap when folded over toward the central area 4. They are then welded individually onto the lower material layer 9, in each case with a weld 5, 6. The area between them is cut along the cutting line 7.

Figure 5:
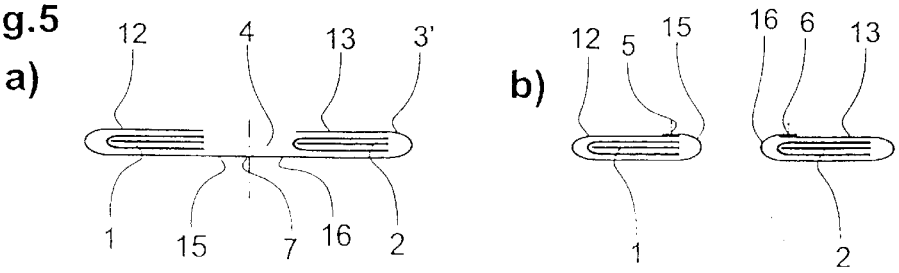
FIGS. 5*a, b* show a further example of a method according to the invention, forming a material tube open at the top.

In the variant of the method according to the invention shown in FIGS. 5*a*), *b*), the printed products are again placed approximately centrally on the packaging material web 3', and the projecting first and second outer material areas 12, 13 are turned over toward the center. In the central area 4, the packaging material web 3' is cut along the cutting line 7. The first and second inner material areas 15, 16 formed as a result are turned over outward, so that they overlap the first and second outer material areas 12, 13. In the overlap area on the flat side of the products 1, 2, the first and second material areas 12 and 15 and 13 and 16, respectively, are welded to each other (welds 5, 6).

Figure 6:
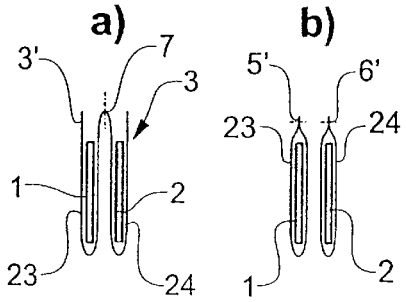
FIGS. 6*a, b* show an example of a method according to the invention, forming two pockets from a packaging material web.

In the variant of the method according to the invention shown in FIGS. 6*a*), *b*), the printed products 1, 2 are inserted, standing upright, into two parallel loops 23, 24 made of a single packaging material web 3' having a U-shaped cross section in each case. The packaging material 3 is severed in the axial direction along a cutting line 7 in the center between the loops. The two material layers of a loop are in each case welded to each other, the welds 5', 6' in this case being applied in the horizontal direction.

Figure 7:
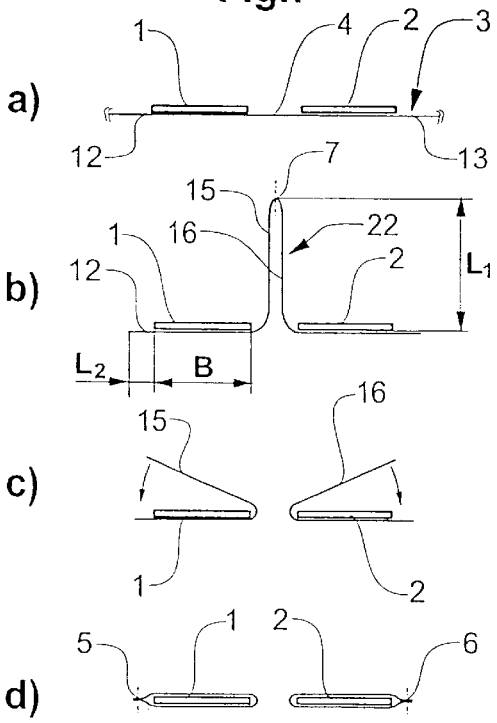
FIGS. 7*a–d* show an example of a method according to the invention, forming a loop of packaging material between the printed products.

FIGS. 7*a*) to *d*) show, in schematic form, four steps in a further variant of the method according to the invention, in which the film-like packaging material 3 is drawn up or forced up in the central area 4 between the two deposited printed products 1, 2, forming a loop 22, FIGS. 7*a*), *b*). The loop 22 has a length L1 and the laterally projecting outer material areas 12, 13 have a length L2, the sum L of the lengths L1 and L2 being greater than the width B of the printed products 1, 2. In addition, L1>B here. The loop 22 is cut centrally at the highest point, cutting line 7, so that loose inner material areas 15, 16 are formed. These are turned over outward and in each case joined to the outer material areas 12, 13 by welds 5, 6, FIGS. 7*c*), *d*).

Figure 8:
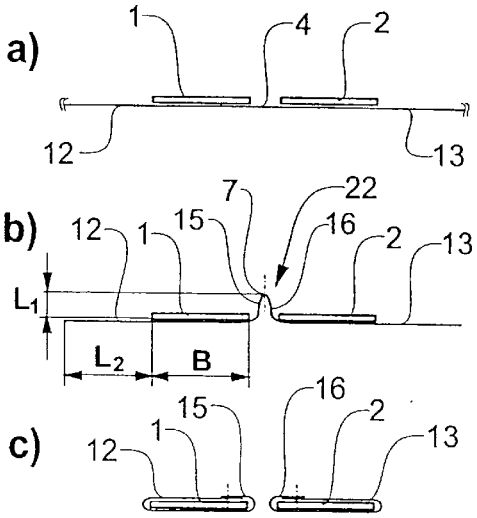
FIGS. 8*a–c* show a further example of a method according to the invention, forming a loop of packaging material between the printed products.
Figure 9:
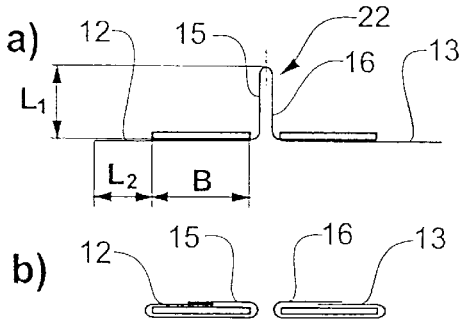
FIGS. 9*a, b* show a third example of a method according to the invention, forming a loop of packaging material between the printed products.

FIGS. 8*a*), *b*), *c*) and 9*a*), *b*) show modifications of this method from FIGS. 7*a*), *b*). In FIGS. 8*a*), *b*), *c*), the length L1 of the loop 22 is less than the length L2 of the outer material areas 12 and 13, and L1<B. The outer material areas 12 and 13 are folded inward, and the inner material areas 15 and 16 are folded outward after the loop 22 has been divided. The material areas are joined to each other in the overlap area on the flat side of the products 1, 2. In FIGS. 9*a*), *b*), the loop 22 has a length L1 which is somewhat greater than half the width B of the printed product. Inner and outer material areas 12, 13, 15, 16 are folded outward and inward, respectively. In the case of the method from FIGS. 8 and 9, welding can advantageously be dispensed with if the material areas overlap to a sufficient extent, since the covering is sufficiently stable because of the transverse welding (not shown).

Figure 10:
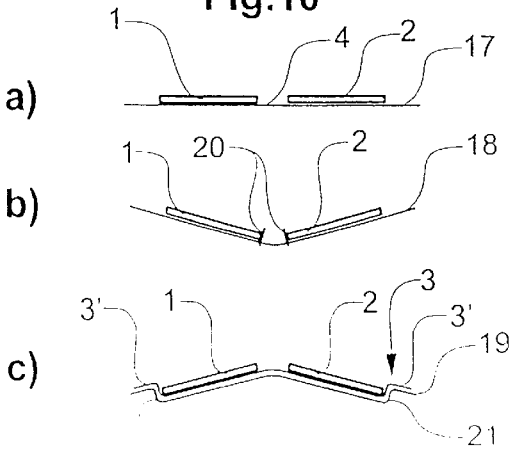
FIGS. 10*a–c* show three examples of the shape of a support for the packaging material.

Finally, FIGS. 10*a*) to *c*) show three variants of supports 17, 18, 19 for the packaging material 3 and the printed products 1, 2. The film-like packaging material 3, not illustrated in FIGS. 10*a*) and 10*b*), is in each case located between the support and the printed products 1, 2. A flat support 17 is shown in FIG. 10*a*). It preferably has an aperture (not illustrated) in the central area 4, in order, in accordance with the method variant illustrated in FIGS. 7 to 9, to be able to form a loop of film by means of pressure from below. The support 18 from FIG. 10*b*) is bent in a V shape in the cross section, so that the printed products 1, 2 placed on the packaging material web (not illustrated here but lying on the support) slide toward the central area 4 because of the force of gravity. In order to produce a defined position of the printed products 1, 2 in relation to each other and in space, the support 18 has contact elements 20, for example webs, in the central area 4, on which the printed products 1, 2 rest. The support 19 from FIG. 10*c*) is likewise bent with a cross section in the shape of a saddle roof and a tip pointing upward. Printed products 1, 2 placed onto the support 19 or onto the packaging material web 3' lying thereon slide outward, on account of the force of gravity, and are retained by contact elements 21, which are formed by a step in the support 19.

While preferred embodiments of the invention have been described, it should be understood that the invention is not so limited, and modifications may be made without departing from the invention. The scope of the invention is defined by the appended claims, and all methods and devices that come within the meaning of the claims, either literally or by equivalence, are intended to be embraced therein.

What is claimed is:

1. A method of enclosing flat printed products with a packaging material in the form of a continuous web, comprising the steps of:

conveying the web of the packaging material in a horizontal conveying direction so that transversely spaced portions of the web are horizontally spaced from each other;

depositing at least one pair of flat printed products on said packaging material web in transversely spaced relationship so that the two products of the pair rest beside each other in transversely aligned relationship on transversely spaced portions of the web;

cutting said packaging material web in the conveying direction in a central area between the two printed products of the pair lying beside each other;

folding over packaging material areas that adjoin the cut outwardly onto respective printed products of the pair of adjacent printed products;

folding over packaging material areas which extend outwardly of respective printed products of the pair of adjacent printed products inwardly onto respective adjacent printed products so that the outwardly and inwardly folded areas at least partially overlap but are not joined together whereby said outwardly and inwardly folded packaging material areas together with the portions of the web on which said pair of flat printed products are deposited enclose said products; and joining said outwardly and inwardly folded areas of said packaging material web together with said portions of said web on which said pair of flat printed products are deposited, transversely of said conveying direction adjacent said pair of printed products, to produce a transversely extending web joinder straight across the entire width of the web.

2. The method as claimed in claim 1, wherein the packaging material web is a plastic film, and said web joinder is created by welding.

3. The method as claimed in claim 1 or 2, further comprising the steps of:

drawing up the packaging material web in the central area to form a loop before cutting said web; and in the cutting step, cutting the loop longitudinally and centrally.

4. The method as claimed in claim 1 or 2, further comprising the step of:

conveying the packaging material web in the axial direction such that the printed products coming from the feed device and deposited on the packaging material web are transported in the conveying direction by the moving packaging material web.

5. The method as claimed in claim 1 or 2, further comprising the step of:

supporting the packaging material web with a support in its travel when printed products are deposited on it.

6. The method as claimed in claim 5, further characterized in that:

said packaging material web is supported by a support which is V-shaped in cross section and, at its center, has two contact elements arranged in parallel in the axial direction for engagement by printed products.

7. The method as claimed in claim 5, further characterized in that:

said packaging material web is supported by a support which has a cross section in the shape of a saddle roof and, at its sides, has two contact elements arranged in parallel in the axial direction for engagement by printed products.

8. The method of claim 5 wherein:

said support comprises two strips running at a distance from each other in the axial direction.

* * * * *